US005527580A

United States Patent [19]

Ikeda et al.

[11] Patent Number: 5,527,580

[45] Date of Patent: Jun. 18, 1996

[54] RUBBER STOPPER FOR VIALS

[75] Inventors: Koji Ikeda, Osaka; Masaru Matsuzaki, Odate; Yoshihide Aoki, Suita, all of Japan

[73] Assignee: Nissho Corporation, Osaka, Japan

[21] Appl. No.: 380,319

[22] Filed: Jan. 30, 1995

Related U.S. Application Data

[63] Continuation of Ser. No. 34,617, Mar. 19, 1993, abandoned, which is a continuation of Ser. No. 691,060, filed as PCT/JP90/01358, Oct. 20, 1990, published as WO91/06276, May 16, 1991, abandoned.

[30] Foreign Application Priority Data

Oct. 26, 1989 [JP] Japan ..... 1-279031

[51] Int. Cl.[6] ..... B65D 39/18

[52] U.S. Cl. ..... 428/68; 215/247; 215/364; 428/76; 428/409; 428/492; 428/494; 428/495; 428/517; 428/519; 428/521; 604/218; 604/230

[58] Field of Search ..... 428/68, 76, 409, 428/494, 495, 492, 517, 519, 521; 215/364, 247; 604/218, 230

[56] References Cited

U.S. PATENT DOCUMENTS

| | | | |
|---|---|---|---|
| 1,652,156 | 12/1927 | Beauchamp | 215/364 |
| 2,696,319 | 12/1954 | Menefee | 215/364 |
| 3,132,983 | 5/1964 | Osborne | 156/307.7 |
| 4,544,125 | 11/1985 | Knapp | 215/364 |
| 4,614,276 | 9/1986 | Ihara | 215/364 |
| 5,009,646 | 4/1991 | Sudo | 604/230 |

FOREIGN PATENT DOCUMENTS

| | | | |
|---|---|---|---|
| 1240048 | 5/1967 | Germany | 215/364 |
| 54-9119 | 4/1979 | Japan . | |
| 57-47637 | 3/1982 | Japan . | |
| 63-196756 | 12/1988 | Japan . | |
| 229029 | 9/1990 | Japan . | |

*Primary Examiner*—Nasser Ahmad
*Attorney, Agent, or Firm*—Armstrong, Westerman, Hattori, McLeland & Naughton

[57] ABSTRACT

A rubber stopper for a vial comprising a body member 1 and a sheet of polyethylene 3 having an average molecular weight of 1,300,000 to 8,000,000, a surface being contacted with an inner surface of a mouth and a liquid medicine, or a top surface 1*b* of which is covered. The molecular chains of polyethylene are partially ramified by heat to be branched and partially crosslinked with a rubber of the body. Therefore, adhesion of them is high and a smoothness of the surface of the sheet portion is improved.

13 Claims, 2 Drawing Sheets

RUBBER STOPPER FOR VIALS

This application is a continuation of application Ser. No. 08/034,617 filed Mar. 19, 1993, now abandoned, which was a continuation of application Ser. No. 07/691,060, filed Jul. 29, 1991, now abandoned, which was the national stage of international application number PCT/JP90/01358, filed Oct. 20, 1990, published as WO91/06276, May 16, 1991.

TECHNICAL FIELD

The present invention relates to a rubber stopper for a vial, and more particularly to a rubber stopper of which body member is laminated with a sheet of polyethylene having an ultra high molecular weight.

BACKGROUND ART

A rubber stopper for a vial, which is covered with a plastic sheet having a chemical resistance on the surface contacted with liquid medicine in order to prevent migration of vulcanization-accelerator, impurities and the like contained in the rubber to the liquid medicine, has been hitherto known (Japanese Examined Patent Publication No. 9119/1979, Japanese Unexamined Patent Publication No. 47637/1982).

Also, there has been known a rubber stopper for a vial, of which top surface is sometimes covered with a plastic sheet having good lubricity in order to improve transportability of the rubber stopper in the process of its production (Japanese Unexamined Patent Publication No. 296756/1988).

As a plastic sheet used in such a covered rubber stopper, a sheet of a fluorocarbon resin having an excellent chemical resistance and a fine smoothness surface has been used (Japanese Examined Patent Publication No. 9119/1979).

However, since the rubber stopper which is covered with the sheet of a fluorocarbon resin lacks in adhesive property to the rubber due to the inactivity of the fluorocarbon resin, after treating the sheet surface with sodium naphthalate for dehalogenation, spattering for etching the surface, adhesive agent for anchor effect and the like, the rubber stopper is adhered to the fluorocarbon resin. Therefore, the process for treating the surface of the sheet is not only complicated but also involves such risk that chemicals used during the abovementioned treatments slightly remain in the rubber stopper and the chemicals are mixed with the liquid medicine in the vial.

In order to solve these problems, the present inventors have eagerly studied. As a result, they have accomplished the present invention.

DISCLOSURE OF THE INVENTION

In accordance with the present invention, there is provided a rubber stopper for a vial of which body is covered with a sheet of polyethylene having an average molecular weight of 1,300,000 to 8,000,000.

In the rubber stopper for a vial, it is preferable that molecular chains of polyethylene are partially ramified by heat to be branched and partially crosslinked with a rubber.

Further, in the rubber stopper for a vial, the portions of the rubber stopper being covered with a sheet of polyethylene can be variously selected. Accordingly, the portions can be an outer surface of a leg portion and a bottom surface of the rubber stopper (i.e. inner surface of a mouth of a vessel and a region (or a part) which is contacted with a liquid medicine), a top surface of a body of the rubber stopper or a whole part of the outer surface of the body of the rubber stopper.

According to the present invention, the body of the stopper is covered with polyethylene having an ultra high molecular weight. When polyethylene is heated, portions of the molecular chains of the polyethylene are partially ramified by heat to branch, and the polyethylene is partially crosslinked with the rubber and they are thermally bonded to each other. Also, since the polyethylene has good self-lubricity, the rubber stopper can be smoothly inserted into the mouth of the vial. Furthermore, even though the vial is stoppered by the rubber stopper, it doesn't happen that the polyethylene is worn out and pieces thereof are mixed with the liquid medicine in the vial.

Hereinafter embodiments of the rubber stopper of the present invention for a vial are explained.

BEST MODE FOR CARRYING OUT THE INVENTION

Figure 1:
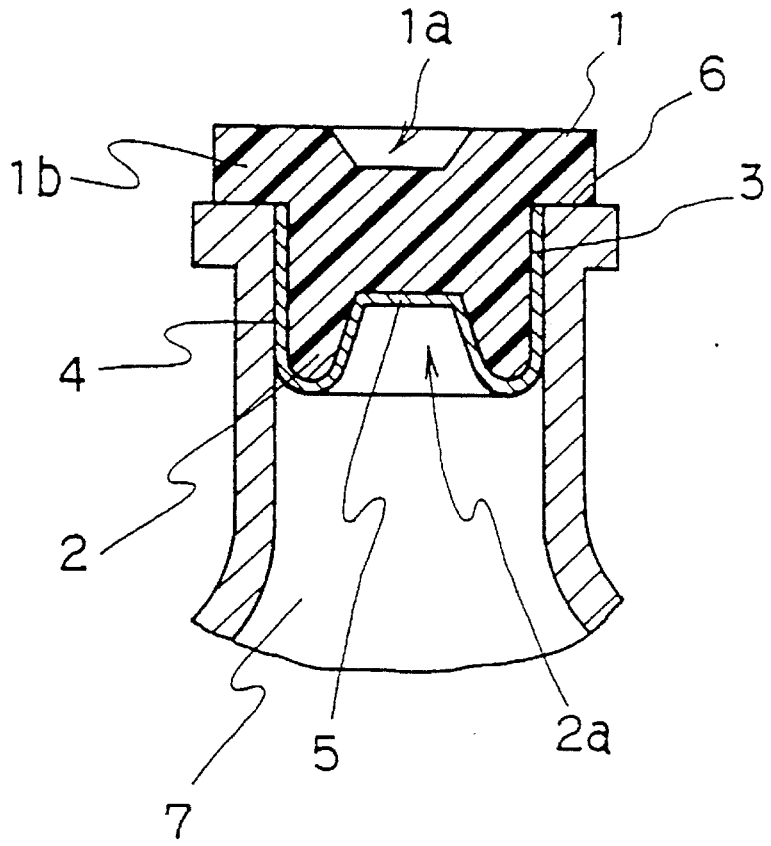
FIG. 1 is an illustrating view showing an embodiment of a rubber stopper inserted into a vial according to present the invention.

In FIG. 1, the numeral 1 denotes a body member, the numeral 2 denotes a leg portion, the numeral 3 denotes a sheet of polyethylene, the numeral 4 denotes an inner surface of a mouth of a vial, the numeral 5 denotes a contact surface of the rubber stopper where liquid medicine contacts, the numeral 6 shows a contact surface of the rubber stopper, which is contacted with the upper end of a vial, and the numeral 7 denotes a vial.

A rubber stopper for a vial shown in FIG. 1 comprises a body member 1 having a leg portion 2 in the center of which a recess portion 1*a* is formed and a top face portion 1*b* which is integratedly molded with the leg portion 2 in the upper end thereof and a sheet of polyethylene 3 with which the body member 1 is covered on an inner surface 4 of a mouth of a vial and on a contact surface 5 contacted with liquid medicine (i.e. on whole surface of the leg portion 2).

As a material of the body member 1, a synthetic rubber such as butyl rubber, isoprene rubber, butadiene rubber, halogenated butyl rubber or silicone rubber or natural rubber is cited.

The body member 1 mentioned in the specification is what combines the upper face 1*b* of the rubber stopper with the leg portion 2 of the rubber stopper.

Also, pharmaceutical is intended to mean medicine such as liquid, tablets and powder medicine.

Polyethylene for the sheet 3 with which the body member 1 is covered has an average molecular weight of 1,300,000 to 8,000,000, preferably 2,000,000 to 6,000,000 (measured by viscometry of ASTM-D2857). In case the average molecular weight is less than 1,300,000, thermal resistance of the sheet becomes poor, and moreover when vulcanizing temperature is too high, the sheet flows during molding, then it tends to be difficult to form a desirable covered rubber stopper. Furthermore, adhesion between a polyethylene sheet and a rubber tends to become worse. In case the average molecular weight is more than 8,000,000, it tends to be difficult to produce a sheet.

Further, polyethylene has a density of 0.930 to 1.000 g/cm$^3$ and a melting point of 134° to 137° C.

The polyethylene sheet having a thickness of 20 to 200 μm, preferably 30 to 100 μm can be produced by rotating a polyethylene molded product having a cylindrical shape and cutting the circumferantial surface thereof with a cutter so as to give a thin sheet. Thus obtained sheet is preferable because the sheet has less internal strain compared with a sheet which is obtained from polyethylene by a melt forming method.

The stopper shown in FIG. 1 can be produced in a manner mentioned hereinafter for instance.

Firstly, a sheet of polyethylene 3, which is formed to the shape closely contacting with a lower mold having a W-like shape cavity in section, is put on a portion of the lower mold, corresponding to the mouth and the surface contacting with liquid medicine of a vial. An unvulcanized rubber is poured onto the sheet to fill a space including a cavity of the lower mold with the unvulcanized rubber, and the unvulcanized rubber is sandwiched between the lower mold and an upper mold. Then they are pressed and heated from above by means of an upper mold having a truncated cone shaped recess. Thereby they are formed into a prescribed shape, and at the same time that the unvulcanized rubber is vulcanized, molecular chains of polyethylene are partially ramified by heat to be branched and the polyethylene is crosslinked with the rubber to bond the rubber with the sheet of polyethylene. Thereby, a rubber stopper for a vial of which body member is covered with the sheet of polyethylene 3 is produced.

As the other method for molding, a method wherein an unvulcanized rubber sheet is piled on a polyethylene sheet and the piled sheets are put between molds, and heated and pressed together so that a rubber stopper for a vial can be produced at one time, a method wherein a base of the stopper (only a leg portion) is previously produced from a polyethylene sheet and an unvulcanized sheet and the base is heated and pressed in molds for forming a top portion to give a rubber stopper for a vial, which is called as a molding method of two-stage vulcanization and the like can be cited. Such methods mentioned above are suitably selected in accordance with the shape of a rubber stopper for a vial.

Figure 2:
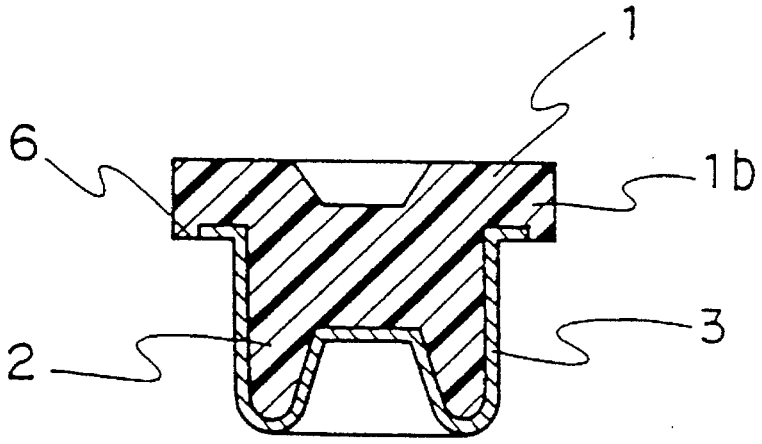
FIGS. 2 to 5 are sectional views, which respectively show other embodiments of the rubber stopper of the present invention.

FIG. 2 shows a rubber stopper for a vial in which the surface of the leg is covered with a polyethylene sheet 3 and moreover the polyethylene sheet is extended to a contact surface 6 of the upper end of a vial. Besides a lower face of an upper face 1*b* is distinctly divided into a face of the polyethylene sheet and a rubber face. One advantage of the stopper is that the liquid medicine is little affected by the rubber and airtightness is excellent.

Figure 3:
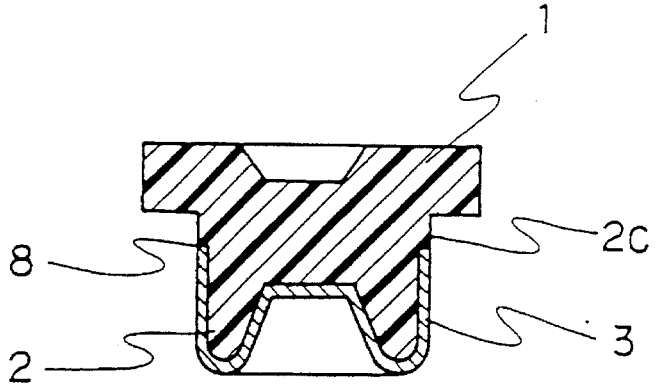

FIG. 3 shows a rubber stopper for a vial of which contact surface of medicine (a portion of the leg other than a base) of a leg 2 is covered with a polyethylene sheet 3. The polyethylene sheet 3 is distinguished from the rubber surface by a side face 8 of the leg portion of the rubber stopper. Such a stopper is used in case a vial is filled with a freeze dried medicine. That is to say, the rubber stopper is used when a vial is sealed by stoppering again after the stopper is half inserted into the mouth portion of the vial and the vial is exhausted. One advantage of the rubber stopper is that the vial is sealed tightly.

Figure 4:
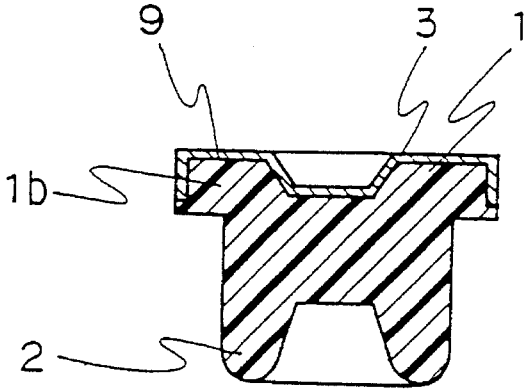

FIG. 4 shows a rubber stopper for a vial in which the surface 9 of the upper face 1*b* is covered with the polyethylene sheet 3. One advantage of the rubber stopper is that transportability in the manufacturing process of the rubber stopper is improved.

Figure 5:
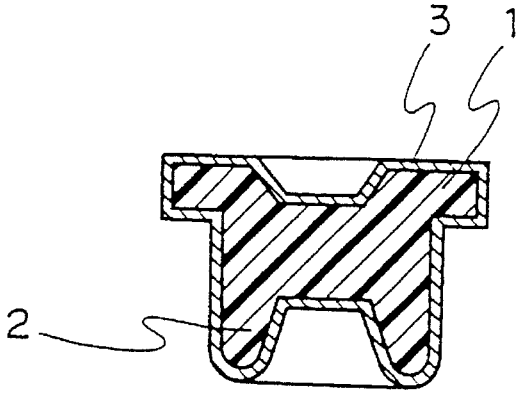

FIG. 5 shows a rubber stopper for a vial of which body member 1 is covered with a polyethylene sheet on the whole surface. One advantage of the rubber stopper is that migration of permanganic acid metal salts is prevented in case of sterilization by ethylene oxide.

Next, further concrete construction and effect of the rubber stopper of the present invention is explained by showing examples and comparative examples.

EXAMPLE 1

A sheet having a thickness of 50 μm was obtained by slicing a cylindrical formed material made of polyethylene ( made by Mitsui Petrochemical Industries, Ltd. ) having an average molecular weight of 4,500,000.

On the other hand, 100 parts by weight of a butyl rubber (Buthyl 365 made by Japan Synthetic Rubber Co., Ltd.), 60 parts by weight of burned clay, 3 parts by weight of active zinc flower, 2 parts by weight of dipentamethylenethiuramtetrasulfide and 5 parts by weight of magnesium oxide were kneaded by means of a kneader and formed by means of two rolls to obtain a rubber sheet having a thickness of 2.5 mm.

A rubber stopper is originally made of the above-mentioned two kinds of sheets as described in Example 2 mentioned later. In order to examine adhesive strength of both sheets and the smoothness of the surface of the synthetic resin sheet, the rubber sheet and the above-mentioned polyethylene sheet were laminated, heated and pressed under the condition of a pressure of 50 kg/cm$^2$, a temperature of 160° C. and a time of 10 minutes to give a laminated sheet of the rubber sheet and the polyethylene sheet. Test pieces produced from the laminated sheet were conducted to the tests.

COMPARATIVE EXAMPLE 1

Using a polytetrafluoroethylene sheet having a thickness of 50 μm of which surface was treated with corona discharge instead of the polyethylene sheet which was used in Example 1, a laminated sheet was produced by piling the sheet on the above-mentioned rubber sheet, and therefrom test pieces for Comparative Example 1 were produced.

The peeling adhesion strength between a rubber layer and a synthetic resin layer and sliding resistance on the surface of a resin sheet of the above-mentioned laminated sheets are shown in Table 1.

A test piece having a width of 10 mm was cut from the laminated sheet, and peeling adhesion shown in the table was conducted to the test piece in accordance with JIS-K 6301 K "Physical Testing Method for Vulcanized Rubber 7 Friction Test".

Also, the sliding resistance was the pulling force when a block gauge having a weight of 60 g was mounted on the surface of the resin sheet and moved at a speed of 500 mm/minute by using the same test piece.

TABLE 1

| | Unit | Example 1 | Comparative Example 1 |
|---|---|---|---|
| Peeling adhesion | kg/cm | 1.5 | 0.3 |
| Sliding resistance | g | 11.5 | 18.7 |

As it is clear from Table 1, it can be expected that the rubber stopper for a vial having the same combination as the laminated sheet of Example 1 has excellent adhesion and fine smoothness of surface superior to the same one as the laminated sheet of Comparative Example 1.

EXAMPLE 2

The polyethylene sheet having a thickness of 50 μm which was used in Example 1 was put on a lower mold having a recess of which depth was 4.5 mm, corresponding to the leg to form. Then the formed article of the polyethylene sheet shown in FIG. 1 was charged in the recess of the lower mold. Further, the unvulcanized rubber sheet used in Example 1 was inserted in the lower mold. At the same time that the sheet was pressed by means of an upper mold and vulcanized by heating under the condition of a temperature of 160° C., a pressure of 200 kg/cm$^2$ and a time of 8 minutes, the polyethylene sheet was partially crosslinked with the rubber to bond tightly.

As a result, a rubber stopper having a construction shown in FIG. 1 was produced. The outside diameter of the portion where contacted with the mouth of the vial was 12.7 mm and the outside dimeter of the upper face was 19.0 min. At that time, 144 pieces of laminated rubber stoppers were produced in one vulcanization process for molding. After the vulcanization was repeated ten times, 1440 pieces of rubber stoppers were produced.

COMPARATIVE EXAMPLE 2

A rubber stopper was produced in the same manner as in Example 2 by using a polytetrafluoroethylene sheet having a thickness of 50 μm used in Comparative Example 1 of which surface was treated with corona discharge instead of the polyethylene sheet used in Example 2.

The adhesion between the rubber and the synthetic resin sheet was judged by a visual observation to inspect the defective ratio.

The stoppers were inserted into a vial of which mouth had an inside diameter of 12.3 mm with a stoppering speed of 50 mm/minute, and the vial was sealed. At the time the resistance was measured by means of an Instron type testing machine. The results are shown in Table 2.

TABLE 2

| | Unit | Example 2 | Comparative Example 2 |
|---|---|---|---|
| Defective ratio | % | 2 | 18 |
| Stoppering resistance | g | 378 | 513 |

As is clear from the results shown in Table 2, the rubber stopper for a vial obtained in Example 2 had less separations of sheets due to adhesive defective during forming of a covered rubber stopper compared with the rubber stopper for a vial obtained in Comparative Example 2, and also was good in stoppering to a vial and had a little damage in the polyethylene layer due to a mouth of the vial.

The rubber stopper for a vial of the present invention is one which is produced by covering a rubber with a specific polyethylene sheet, and the rubber layer is strongly bonded with the polyethylene sheet by merely heating and pressing them without any surface treatment of the sheet. Therefore, the rubber stopper is also excellent in economics.

Also, the surface of the polyethylene sheet of the rubber stopper for a vial of the present invention is excellent in smoothness of the surface and the stopper can be easily inserted into a vial. Therefore, medicine in the vial is not polluted by mixing pieces of the polyethylene sheet in the medicine because the sheet is free from wear when the rubber stopper is stoppered.

We claim:

1. A rubber stopper for a vial comprising a body member of vulcanized rubber, a surface of the body member being laminated with a sheet of polyethylene having a viscosity-average molecular weight of 1,300,000 to 8,000,000 as measured by viscometry of ASTM-D 2857 wherein unvulcanized rubber is laminated directly with the sheet of polyethylene without surface treatment of the sheet such that the molecular chains of said polyethylene are partially branched by heat and partially cross-linked with the rubber of the body member at the same time that the unvulcanized rubber is vulcanized.

2. The rubber stopper for a vial of claim 1, wherein a portion being contacted with an inner surface of a mouth of a vial and a portion being contacted with liquid medicine are respectively covered with the sheet of polyethylene.

3. The rubber stopper for a vial of claim 1, wherein at least the upper surface of a top surface of the body member of the rubber stopper is laminated with the sheet of polyethylene.

4. The rubber stopper for a vial of claim 1, wherein the whole of the outer surface of the body member of the rubber stopper is covered with the sheet of polyethylene.

5. A rubber stopper for a vial comprising a body member of vulcanized rubber having a leg portion to be inserted into a mouth of the vial and a top portion with an under surface to be brought into contact with the upper end of the vial when the rubber stopper is inserted into the mouth of the vial, at least a part of a surface of the body member being laminated with a sheet of polyethylene having a viscosity-average molecular weight of 1,300,000 to 8,000,000 as measured by viscometry of ASTM-D 2857 wherein unvulcanized rubber is laminated directly with the sheet of polyethylene without surface treatment of the sheet such that the molecular chains of the polyethylene are partially branched by heat and partially cross-linked with the rubber of the body member at the same time that the unvulcanized rubber is vulcanized.

6. The rubber stopper of claim 5, wherein the surface of the leg portion is laminated with the sheet of polyethylene.

7. The rubber stopper of claim 6, wherein the sheet of polyethylene extends on the under surface of the top portion to cover the under surface to be brought into contact with the upper end of the vial.

8. The rubber stopper of claim 5, wherein at least the upper surface of the top portion of the body member is laminated with the sheet of polyethylene.

9. The rubber stopper of claim 5, wherein the entire surface of the body member is laminated with the sheet of polyethylene.

10. A stoppered vial consisting essentially of a vial and a rubber stopper, the rubber stopper comprising a body member of vulcanized rubber having a leg portion inserted into a mouth of the vial and a top portion with an under surface contacting the upper end of the vial, and at least a part of a surface of the body member being laminated with a sheet of polyethylene having a viscosity-average molecular weight of 1,300,000 to 8,000,000 as measured by viscometry of ASTM-D 2857 wherein unvulcanized rubber is laminated directly with the sheet of polyethylene without surface treatment of the sheet such that the molecular chains of the polyethylene are partially branched by heat and partially cross-linked with the rubber of the body member at the same time that the unvulcanized rubber is vulcanized.

11. The rubber stopper of claim 1, wherein the vulcanization is conducted at a temperature above the melting point of the polyethylene.

12. The rubber stopper of claim 5, wherein the vulcanization is conducted at a temperature above the melting point of the polyethylene.

13. The rubber stopper of claim 10, wherein the vulcanization is conducted at a temperature above the melting point of the polyethylene.

* * * * *